US010081027B2

(12) United States Patent
Brand et al.

(10) Patent No.: US 10,081,027 B2
(45) **Date of Patent: *Sep. 25, 2018**

(54) MARKER AIRBRUSH

(71) Applicant: Crayola LLC, Easton, PA (US)

(72) Inventors: Douglas Brand, Easton, PA (US); Adam Scott Sharp, Sellersville, PA (US); Thomas R. Rau, Easton, PA (US); Adam Sandt, Durham, NC (US); John D. McBride, Jr., Easton, PA (US)

(73) Assignee: CRAYOLA, LLC, Easton, PA (US)

( * ) Notice: Subject to any disclaimer, the term of this patent is extended or adjusted under 35 U.S.C. 154(b) by 242 days.

This patent is subject to a terminal disclaimer.

(21) Appl. No.: 14/676,026

(22) Filed: Apr. 1, 2015

(65) Prior Publication Data

US 2015/0202641 A1 Jul. 23, 2015

Related U.S. Application Data

(62) Division of application No. 14/089,965, filed on Nov. 26, 2013, now Pat. No. 9,713,815.

(Continued)

(51) Int. Cl.
*B05B 7/24* (2006.01)

(52) U.S. Cl.
CPC ..... *B05B 7/2424* (2013.01); *B05B 7/2408* (2013.01); *B05B 7/2413* (2013.01); *B05B 7/2418* (2013.01)

(58) Field of Classification Search
CPC ... B05B 7/2418; B05B 7/2424; B05B 7/2429; B05B 7/2413; B05B 7/2408;

(Continued)

(56) References Cited

U.S. PATENT DOCUMENTS 5,156,684 A * 10/1992 Mayer ..... B05B 7/0416 118/301
5,842,646 A * 12/1998 Kitajima ..... B05B 7/2459 239/345

(Continued)

FOREIGN PATENT DOCUMENTS

EP 0208247 A1 1/1987

OTHER PUBLICATIONS

Non-Final Office Action dated May 7, 2015 in U.S. Appl. No. 14/089,965, 12 pages.

(Continued)

*Primary Examiner* — Alexander Valvis
*Assistant Examiner* — Cody Lieuwen
(74) *Attorney, Agent, or Firm* — Shook, Hardy & Bacon L.L.P.

(57) ABSTRACT

A marker airbrush device for transferring marking solution from a marking device onto a writing surface using air is provided. The airbrush device includes a housing with an air outlet, a trigger for controlling an amount of air travelling through the air outlet, and a marker positioner coupled to the housing. The marker positioner positions a marking device relative to the air outlet such that air traveling through the air outlet contacts at least one surface of the marking device to transfer marking solution onto a writing surface. In embodiments, rotation of a portion of the marker positioner advances and/or retracts the marking device with respect to the flow of air through the air outlet, thereby altering the angle and/or amount of air that contacts the marking device during spraying.

19 Claims, 9 Drawing Sheets

Related U.S. Application Data

(60) Provisional application No. 61/729,833, filed on Nov. 26, 2012.

(58) Field of Classification Search
CPC ... B05B 7/2489; B05B 7/2491; B05B 7/2483; B05B 7/247; B05B 7/2459; B05B 7/2478; B05B 7/1209; B05B 7/2435; B05B 11/068; B05B 15/065
USPC ..... 239/310, 311, 315, 316, 326, 337, 341, 239/346, 353, 354, 376–378, 409, 420, 239/433, DIG. 14, 154, 300, 301, 369, 239/600
See application file for complete search history.

(56) References Cited

U.S. PATENT DOCUMENTS

| | | | | |
|---|---|---|---|---|
| 6,892,960 | B2 * | 5/2005 | Ptak | B05B 7/2416 239/346 |
| 7,213,774 | B1 | 5/2007 | Kitajima | |
| 7,607,591 | B2 | 10/2009 | Barch et al. | |
| 8,052,072 | B2 | 11/2011 | Kriesmair | |
| 9,713,815 | B2 | 7/2017 | Brand et al. | |
| 2003/0071144 | A1 | 4/2003 | Naemura | |
| 2009/0261182 | A1 * | 10/2009 | Bolton | B05B 7/2459 239/346 |
| 2010/0038453 | A1 | 2/2010 | Barch et al. | |
| 2010/0252143 | A1 * | 10/2010 | Juo | B05B 7/2408 141/351 |

OTHER PUBLICATIONS

Non-Final Office Action dated Apr. 29, 2016 in U.S. Appl. No. 14/089,965, 22 pages.
Final Office Action dated Oct. 28, 2015 in U.S. Appl. No. 14/089,965, 13 pages.
Final Office Action dated Aug. 31, 2016 in U.S. Appl. No. 14/089,965, 23 pages.
Non-Final Office Action dated Dec. 28, 2016 in U.S. Appl. No. 14/089,965, 12 pages.
Non-Final Office Action in U.S. Appl. No. 15/408,022 dated Jun. 6, 2018, 16 pages.

* cited by examiner

MARKER AIRBRUSH

CROSS-REFERENCE TO RELATED APPLICATIONS

This application is a divisional of and claims priority to U.S. Nonprovisional application Ser. No. 14/089,965, entitled "Marker Airbrush," filed Nov. 26, 2013, which claims priority to U.S. Provisional Application No. 61/729,833, entitled "Marker Airbrush," filed Nov. 26, 2012, the entire disclosure of both of which is hereby incorporated by reference in its entirety.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed Description section below. This summary is not intended to identify key features or essential features of the claimed subject matter, nor is it intended to be used as an aid in isolation to determine the scope of the claimed subject matter. In brief and at a high level, this disclosure describes, among other things, a marker airbrush device for transferring marking solution from a marking device onto a writing surface using air. The marker airbrush device includes a housing with an air outlet and a marker positioner. In embodiments, the marker positioner holds the marker at a particular depth relative to the air outlet. A hand-pumping device may direct air through the housing of the marker airbrush device, and the flow of air can be controlled using a trigger on the housing of the marker airbrush device.

DESCRIPTION OF THE DRAWINGS

Illustrative embodiments of the invention are described in detail below with reference to the attached drawing figures, and wherein.

DETAILED DESCRIPTION

Figure 1:
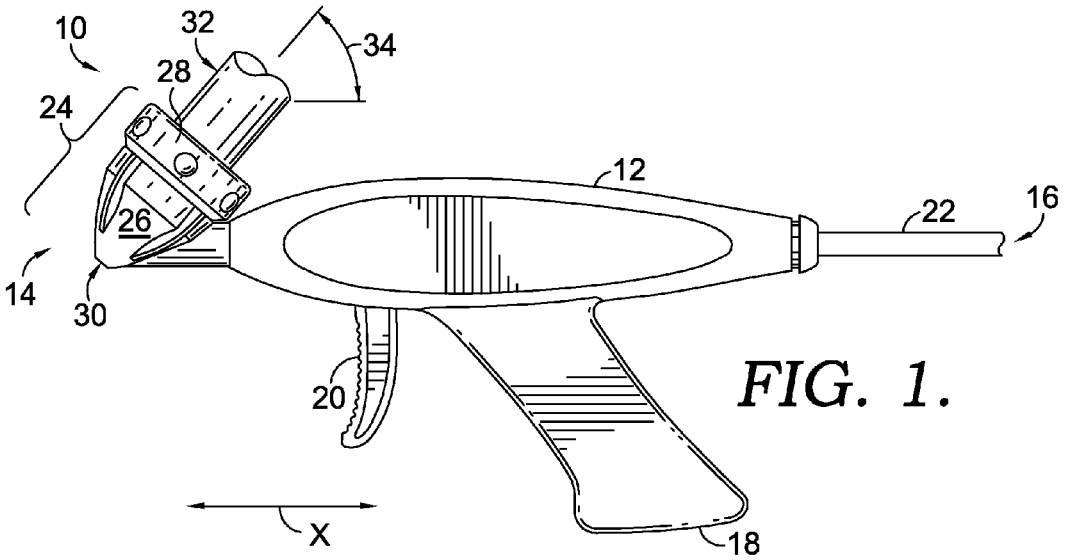
FIG. 1 is a side view of a marker airbrush device with a marking device coupled to the marker airbrush device, in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

In one embodiment of the invention, a marker airbrush device includes a housing comprising an air outlet and a trigger for controlling an amount of air travelling through the air outlet; and a marker positioner coupled to the housing, wherein the marker positioner positions at least a portion of a marking device relative to the air outlet such that air traveling through the air outlet contacts at least a portion of the marking device to transfer marking solution from the marking device onto a writing surface.

In another embodiment of the invention, a marker airbrush device includes a housing having a first end and a second end, the housing comprising an air outlet, an opening through which air travelling through the air outlet exits the housing, and a trigger for controlling an amount of air travelling through the air outlet; a marker positioner coupled to the first end of the housing, wherein the marker positioner positions at least a portion of a marking device at a particular depth relative to the air outlet such that air traveling through the air outlet contacts at least one surface of the marking device to transfer marking solution from the marking device onto a writing surface, wherein the marker positioner comprises a rotatable collar for adjusting a position of at least a portion of the marking device at the particular depth relative to the air outlet, wherein at least a portion of the rotatable collar rotates around a circumference of a marker housing of the marking device, and further wherein the marker positioner comprises a height adjustment mechanism coupled to the rotatable collar, wherein rotation of the rotatable collar in a first direction advances the marking device into a path of air flowing through the air outlet based on travel of the height adjustment mechanism relative to the housing, and wherein rotation of the rotatable collar in a second direction retracts the marking device from the path of air flowing through the air outlet based on travel of the height adjustment mechanism relative to the housing; and a hand-pumping device coupled to the second end of the housing, the hand-pumping device adapted to pump air through the air outlet.

In a further embodiment, a marker airbrush device includes a housing having a first end and a second end, the housing comprising: an air outlet, a trigger for controlling an amount of air travelling through the air outlet; a marker positioner coupled to the first end of the housing, wherein the marker positioner positions at least a portion of a marking device at an angle relative to the housing such that air traveling through the air outlet contacts at least one surface of the marking device, wherein the marker positioner comprises a hollow interior tapered towards the opening and a stabilizing ring that secures the position of the marking device inside the marker positioner; and an opening through which air traveling through the air outlet exits the marker positioner.

Referring initially to FIG. 1, a marker airbrush device 10 is depicted in accordance with an embodiment of the invention. The marker airbrush device 10 includes a housing 12 having a first end 14 and a second end 16 arranged along a central x-axis. The airbrush device 10 includes a handle 18 and a trigger 20. Although depicted as a lever to be pulled in relation to the handle 18, the trigger 20 may be any sort of device used to provide an indication of stopping and starting the flow of air through the marker airbrush device 10. For example, the trigger 20 may be a button or a sensor that a user contacts to indicate when air should flow through marker airbrush device 10.

Marker airbrush device 10 further includes a piece of tubing 22 coupled to the second end 16 of the housing 12. The tubing 22 provides an input for an air source, such as the air pump device 46 discussed below with reference to FIGS. 5 and 6. In embodiments, air pumped into the second end 16 of the housing 12 travels through the housing 12 (via air outlet 40 depicted in FIG. 2) and exits the airbrush device 10 via opening 30, after passing through the marker positioner 24. Embodiments of the marker positioner 24 include a conical tip 26, a rotatable collar 28 that rotates around a circumference of a marking device 32, and an opening 30. As shown in FIG. 1, a marking device 32 may be secured by the marker positioner 24, and positioned at an angle 34 relative to the horizontal x-axis of the marker airbrush device 10.

Figure 2:
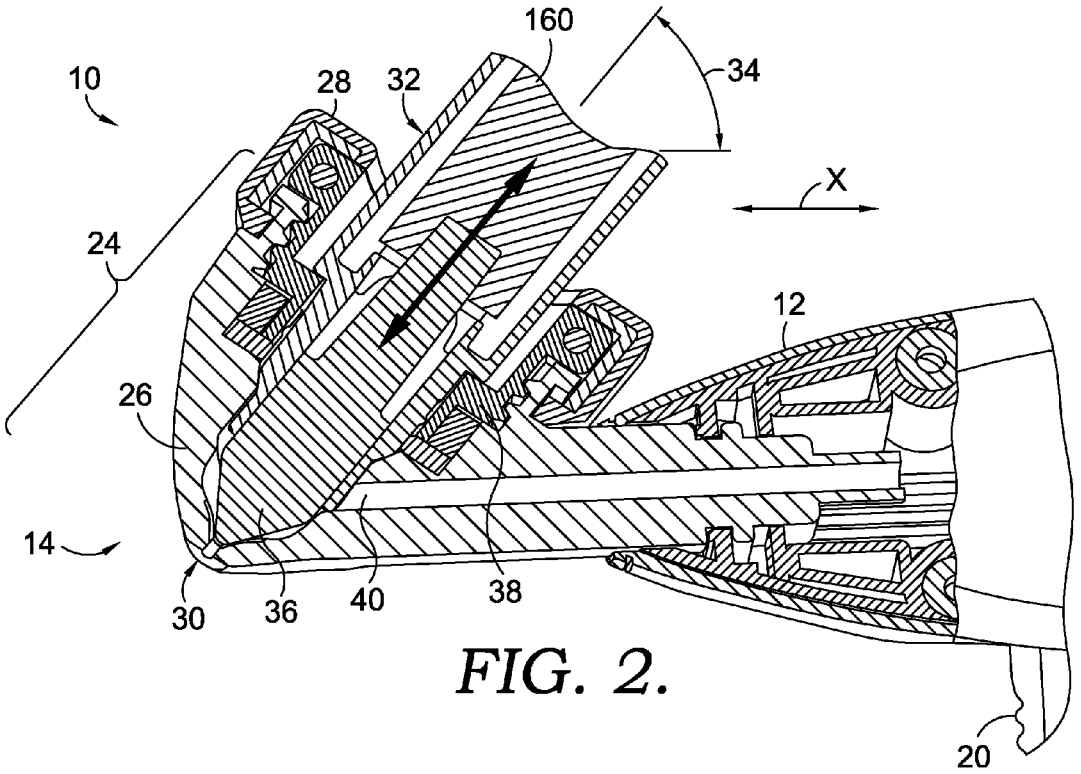
FIG. 2 is an enlarged, side view of the marker airbrush device of FIG. 1, partially tilted away from the plane of view, with a portion of the marker airbrush device and the marking device cut away, in accordance with an embodiment of the invention.

In one embodiment, the marker positioner 24 is used to adjust the position of the marking device 32 with respect to one or more parts of the marker airbrush device 10. With reference to FIG. 2, a cut-away portion of the marker airbrush device 10 includes the marking device 32 with a marker nib 36 adjoining a marker reservoir 160. In embodiments, the marker nib 36 and/or marker reservoir 160 is saturated with an amount of marking solution. In the embodiment of FIG. 2, marker nib 36 is depicted as having a pointed configuration at a first end of the marker nib 36. FIG. 2 also depicts the height adjustment mechanism 38 coupled to the rotatable collar 28 of the marker positioner 24. In one example, rotation of the rotatable collar 28 in a first direction may advance the marking device 32 into a path of air flowing through the air outlet 40 based on travel of the height adjustment mechanism 38 relative to the housing 12. Further, rotation of the rotatable collar 28 in a second direction may retract the marking device 32 from the path of air flowing through the air outlet 40 (and exiting the housing 12 via opening 30) based on travel of the height adjustment mechanism 38 relative to the housing 12. As depicted in FIG. 2, air flowing through air outlet 40 may travel across the marker nib 36, collect an amount of marking solution in the air stream, and release a spray of marking solution out of the opening 30, thereby creating an "airbrush" effect. In other words, the marker airbrush device 10 may transfer marking solution from the marking device 32 (i.e., from the marker nib 36) out of the first end 14 of the marker airbrush device 10, and onto a writing surface.

Embodiments of the invention may utilize many kinds of marking devices 32, having marker nibs 36 and/or marker reservoirs 160 saturated with multiple types of marking solutions. For example, the marker airbrush device 10 may be used with a variety of broad line markers, such as Regular, Washable, Pip-Squeaks®, Crystal Effects, Window and Bright Fabric markers, by Crayola® LLC of Easton, Pa. As such, embodiments of the marking solution may be a washable marker solution, a non-washable marker solution, a fabric-writing marker solution, a window-writing marker solution, a special-effects marker solution and/or a permanent marker solution. In one embodiment, a marker device secured by the marker airbrush device 10 is a regular-sized marking device having a standard-sized barrel and/or housing diameter, while in other embodiments, the marker device secured by the marker airbrush device 10 is a miniature-sized marking device having a barrel and/or housing that is smaller in diameter than the regular-sized marking device. As such, the marker airbrush device 10 may be adjusted for use with either regular-sized or miniature-sized marking devices. Additionally, the marker airbrush device 10 may be used to transfer solution from a variety of marking devices 32, including but not limited to markers having a marker nib 32 saturated in marking solution. In embodiments, marking device 32 is removable from marker airbrush device 10, such that multiple different marking devices may be used individually with marker airbrush device 10.

Figure 3:
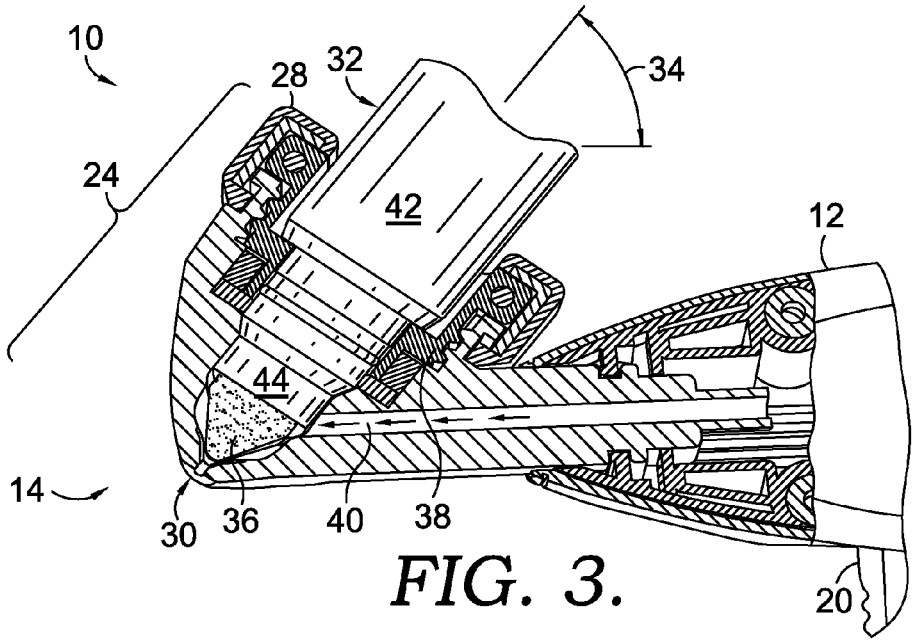
FIG. 3 is an enlarged, side view of the marker airbrush device of FIG. 1, partially tilted away from the plane of view, with a portion of the marker airbrush device cut away, in accordance with an embodiment of the invention.

Turning now to FIG. 3, additional exemplary details of the marker airbrush device 10 of FIG. 1 are depicted with a portion of the housing 12 cut away to reveal how the air flowing through air outlet 40 contacts one or more surfaces of a marking device 32. In one embodiment, the marker housing 42 that encloses marking device 32 is shown as being secured by the adjustment mechanism 38 and/or rotatable collar 28 of the marker positioner 24. The marker housing 42 of the marking device 32 also includes a marker housing collar 44 near the tip of the marking device 32. In one embodiment, air flowing through the air outlet 40 passes over both a portion of the marker housing collar 44 and a portion of the marker nib 36 prior to exiting the housing 12 via opening 30 (at the first end 14 of the marker airbrush device 10).

Accordingly, adjustment of a height and/or depth of the marking device 32 (relative to the interior of the air outlet 40) by the marker positioner 24 may adjust the portion of the marking device 32 that is contacted by the air flow through air outlet 40. In one embodiment, a portion of the marker housing collar 44 and a portion of the marker nib 36 are contacted by air flowing through the air outlet 40. In some embodiments, the path of such flowing air is altered by the contact with the marker housing collar 44 and/or the marker nib 36. As such, the resulting airbrush spray of marking solution from the marking device 32 may be altered by the depth of the placement of the marking device 32 (i.e., by how much of the marker nib 36 and/or marker housing collar 44 are held in the path of the air flow by the marker positioner 24). Further, in additional embodiments, rotation of the rotatable collar 28 and the corresponding travel of the adjustment mechanism 38 may be used to advance or retract the marking device 32 into or away from the air outlet 40, such that different amounts of the marking device 32 may interfere with the air flowing through air outlet 40.

In one embodiment, marking device 32 is secured at a first position relative to the housing 12 and/or air outlet 40, by the marker positioner 24. Upon adjustment of the marker positioner 24, based on rotation of the rotatable collar 28 and travel of the adjustment mechanism 38, the marking device 32 may be shifted into a second position relative to the housing 12 and/or the air outlet 40. In other words, the marker positioner 24 may adjust the position of the marking device 32 from a first position to a second position, thereby altering the depth of the marker nib 36 (and/or marker housing collar 44) as inserted into the stream of air flowing through air outlet 40. In some embodiments, an amount of marking solution carried by the air flowing through air outlet 40 (and across the marker nib 36) may be altered by the depth of placement of the marking device 32. For example, advancement from a first position to a second, closer position, may cause more marking solution to be transferred from the marking device 32 to a marking surface, such as a piece of paper. Similarly, in another example, retraction from a second position to a first, more distant position, may cause less marking solution to be transferred from the marking device 32 to a marking surface. As such, an amount of marking solution used to create an "airbrush" effect may be altered by the adjustment mechanism 38 of the marker positioner 24, based on rotation of the rotatable collar 28.

Figure 4:
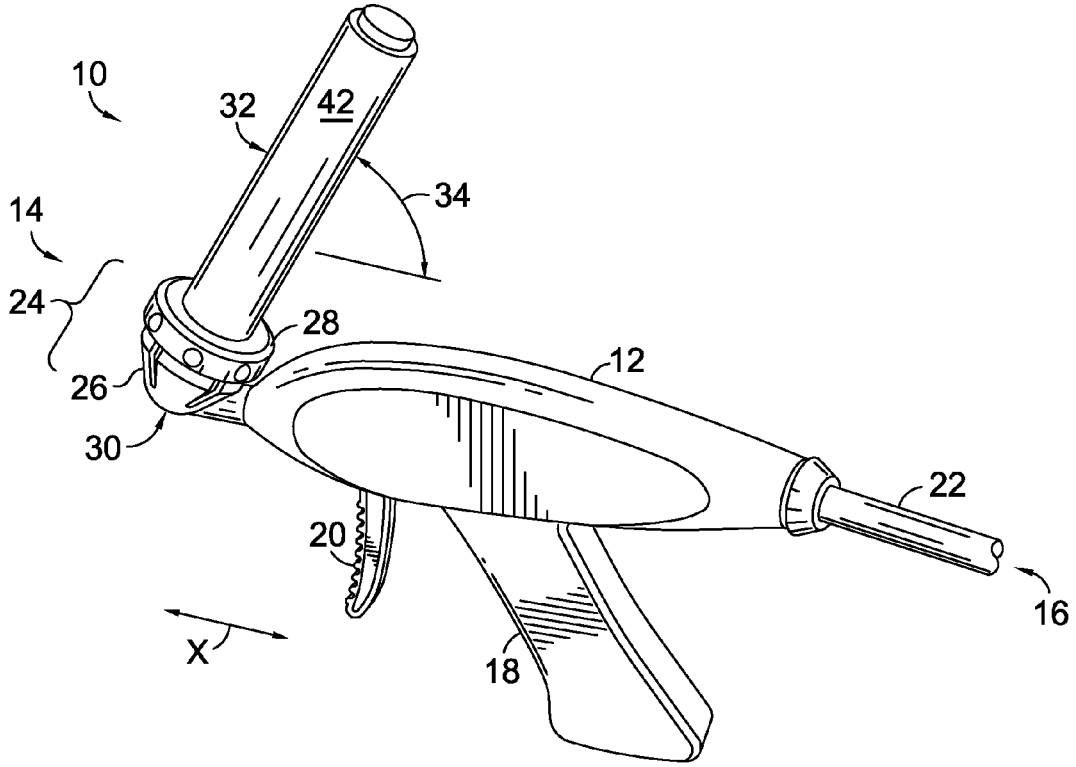
FIG. 4 is a rear, perspective view of the marker airbrush device of FIG. 1, in accordance with an embodiment of the invention.

With reference to FIG. 4, a rear perspective view of the marker airbrush device 10 depicts the cylindrical shape of the marker housing 42, and the circular shape of the rotatable collar 28 of the marker positioner 24. In one embodiment, depression of the trigger 20 causes air to be passed through the tubing 22, through the air outlet 40 (shown in FIGS. 2-3) of the housing 12, through at least a portion of the marker positioner 24, and out the opening 30. In embodiments, to adjust the spray of airbrushed marking solution that exits the opening 30 with the air flow, rotatable collar 28 may be rotated to adjust the depth of the marking device 32 that is in contact with the air flow. Accordingly, marker positioner 24 may maintain the angle 34 of placement of the marking device 32 relative to the x-axis while adjusting the height and/or depth of the marking device 32 relative to the air outlet 40 and/or housing 12.

Figure 5:
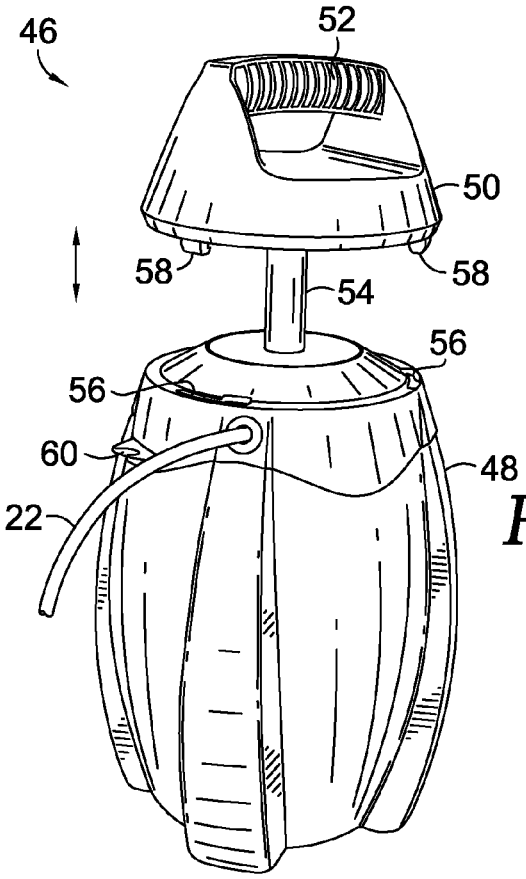
FIG. 5 is a perspective view of a hand-pumped air-pumping device in an extended position, in accordance with an embodiment of the invention.
Figure 6:
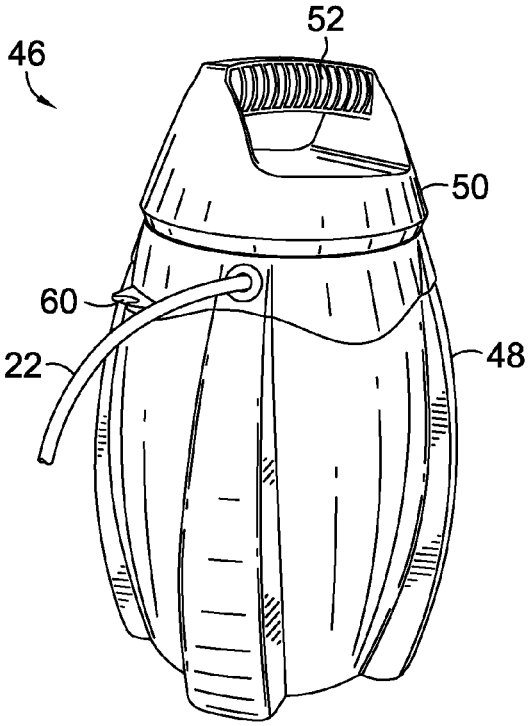
FIG. 6 is a perspective view of a hand-pumped air-pumping device in a compressed position, in accordance with an embodiment of the invention.

Referring next to FIGS. 5 and 6, a hand-pumped air-pumping device 46 includes a pump housing 48, an upper housing 50 with a handle 52, and a center pump guide 54. The upper housing 50 travels vertically with respect to the pump housing 48, along the center pump guide 54, to produce an amount of air to be forced into the marker airbrush device 10 of FIG. 1, via tubing 22. As shown in the extended position of FIG. 5, a user may pump the air-pumping device 46 vertically with respect to the pump housing 48 and upper housing 50. In embodiments, upper housing 50 may be secured to the pump housing 48 when in a compressed position, by mating the slots 56 around the perimeter of the pump housing 48 with the tabs 58 around the perimeter of the upper housing 50. In embodiments, airbrush holster 60 may be coupled to a portion of the housing 12 of the marker airbrush device 10 (shown in FIG. 1). As such, in one embodiment, tubing 22 is coupled to the second end 16 of the marker airbrush device 10, and to the pump housing 48 of the air-pumping device 46.

As will be understood, the exemplary air-pumping device 46 is only one example of a hand-powered air-pumping device that can be used to pump air through the marker airbrush device 10. Although embodiments of the invention are described above with respect to air pumped from a hand-pumping device, such is not intended to limit embodiments to any particular device or configuration for providing air to flow through the marker airbrush device 10. Accordingly, in some embodiments, a mechanical, automatic, electrically powered, and/or partially manually powered pumping device may be used to provide air to the marker airbrush device 10.

Figure 7:
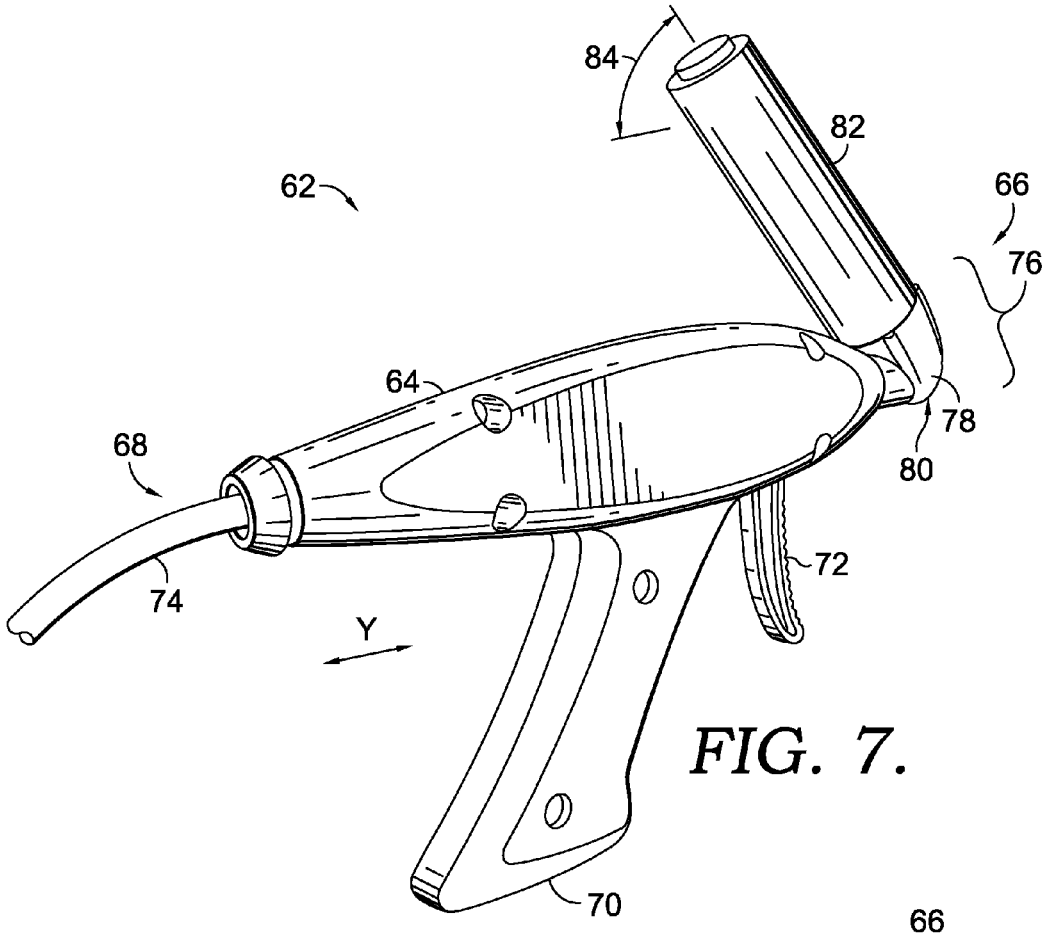
FIG. 7 is a perspective view of a marker airbrush device, with a marking device coupled to the marker airbrush device, in accordance with an embodiment of the invention.

Turning now to FIG. 7, a marker airbrush device 62 is depicted in accordance with an embodiment of the invention. The marker airbrush device 62 includes a housing 64 having a first end 66 and a second end 68 arranged along a central y-axis. The airbrush device 62 includes a handle 70 and a trigger 72. Although depicted as a lever to be pulled in relation to the handle 70, the trigger 72 may be any sort of device used to provide an indication of stopping and starting the flow of air through the marker airbrush device 62. For example, the trigger 72 may be a button or a sensor that a user contacts to indicate when air should flow through marker airbrush device 62.

Marker airbrush device 62 further includes a piece of tubing 74 coupled to the second end 68 of the housing 64. The tubing 74 provides an input for an air source, such as the air pump device 46 discussed above with reference to FIGS. 5 and 6. In embodiments, air pumped into the second end 68 of the housing 64 travels through the housing 64 (via air outlet 86 depicted in FIG. 8) and exits the airbrush device 62 via opening 80, after passing through the marker positioner 76. Embodiments of the marker positioner 76 include a conical tip 78 that accepts the marking end of a marking device 82. The marking device 82 may have a marker nib that is saturated with an amount of marking solution, such that the solution saturating the marking device is "airbrushed" onto a surface based on air traveling through the marker airbrush device 62. As shown in FIG. 7, a marking device 82 may be secured by the marker positioner 76, and positioned at an angle 84 relative to the horizontal y-axis of the marker airbrush device 62.

Figure 8:
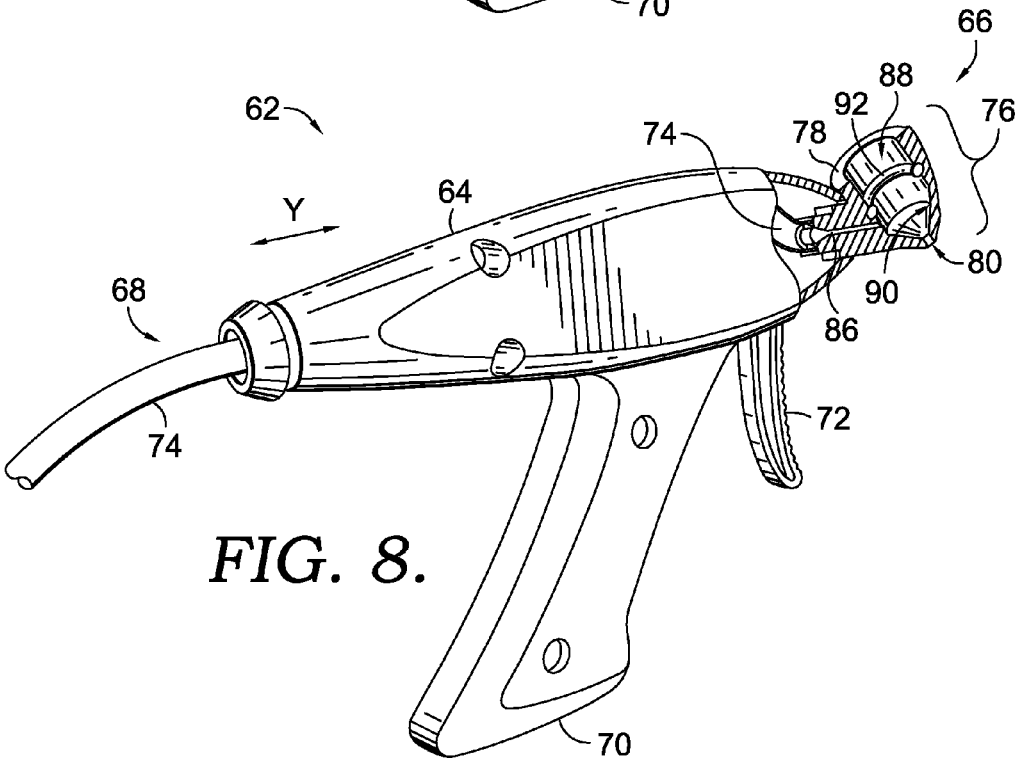
FIG. 8 is a perspective view of the marker airbrush device of FIG. 7, with a portion of the marker airbrush device cut away in accordance with an embodiment of the invention.

In one embodiment, the marker positioner 76 positions the marking device 82 with respect to one or more parts of the marker airbrush device 62. With reference to FIG. 8, a cut-away portion of the marker airbrush device 62 includes a conical tip 78 that tapers towards the opening 80. Air traveling from tubing 74 through the air outlet 86 enters the hollow interior 88 of the conical tip 78. The hollow interior 88 has a tapered surface 90 near the opening 80 and a stabilizing ring 92 that secures the position of the marking device 82 inside the marker positioner 76. The stabilizing ring 92 surrounds at least a portion of the circumference of the hollow interior 88, and may be made of any material that creates resistance against the outer surface of a marking device 82, such as a rubber gasket.

In one embodiment, coupling of the marking device 82 with the stabilizing ring 92 secures the marking device 82 inside the marker positioner 76 such that the air flowing from the air outlet 86 contacts at least a portion of the marker nib on the marking device 82. In some embodiments, the air from air outlet 86 contacts at least a portion of a collar of the marking device and at least a portion of the marker nib. As such, air contacting the marking device 82 may be "targeted" to contact a particular portion of the marking device 82 based on positioning of the marking device 82 inside marker positioner 76 (and the corresponding orientation of the marking device 82 inside the hollow interior 88). In one example, air flowing through air outlet 86 may travel across the nib of the marking device 82, collect an amount of marking solution in the air stream, and release a spray of marking solution out of the opening 80 to create an "airbrush" effect. In other words, the marker airbrush device 62 may transfer marking solution from the marking device 82 (i.e., from the marker nib) out of the first end 66 of the marker airbrush device 62, and onto a writing surface.

Embodiments of the invention may utilize many different kinds of marking devices 82, having marker nibs and/or marker reservoirs saturated with multiple different types of marking solutions. For example, the marker airbrush device 62 may be used with a variety of broad line markers, such as Regular, Washable, Pip-Squeaks®, Crystal Effects, Window and Bright Fabric markers, by Crayola® LLC of Easton, Pa. Additionally, the marker airbrush device 62 may be used to transfer solution from a variety of different types of marking devices 82, including but not limited to markers having a marker nib saturated in marking solution. In embodiments, marking device 82 is removable from marker airbrush device 62, such that multiple different marking devices may be used individually with marker airbrush device 62. In some embodiments, stabilizing ring 92 may be adapted to secure different types of marking devices 82, such as marking devices having different circumferences or different shaped housings and/or nibs. In one embodiment, a marker device 82 secured by the marker airbrush device 62 is a regular-sized marking device 82 having a standard-sized barrel and/or housing diameter, while in other embodiments, the marker device 82 secured by the marker airbrush device 62 is a miniature-sized marking device 82 having a barrel and/or housing that is smaller in diameter than the regular-sized marking device.

Figure 9:
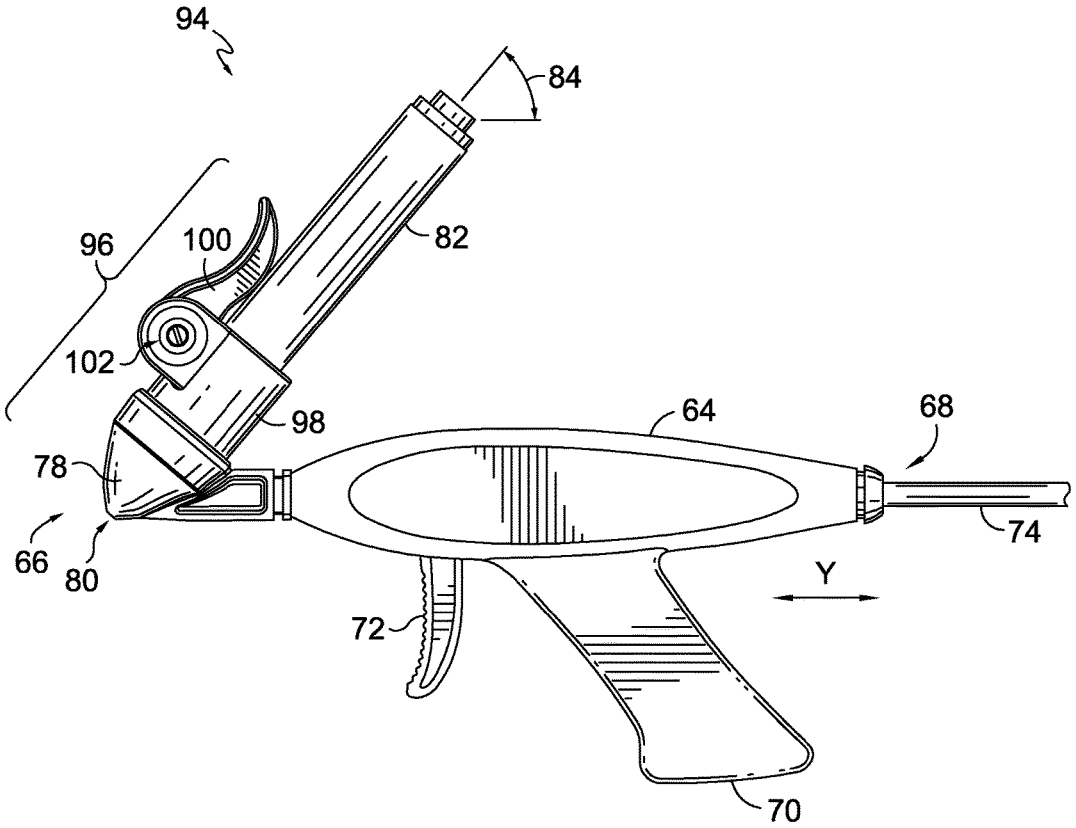
FIG. 9 is a side view of a marker airbrush device with a marking device coupled to the marker airbrush device, in accordance with an embodiment of the invention.
Figure 10:
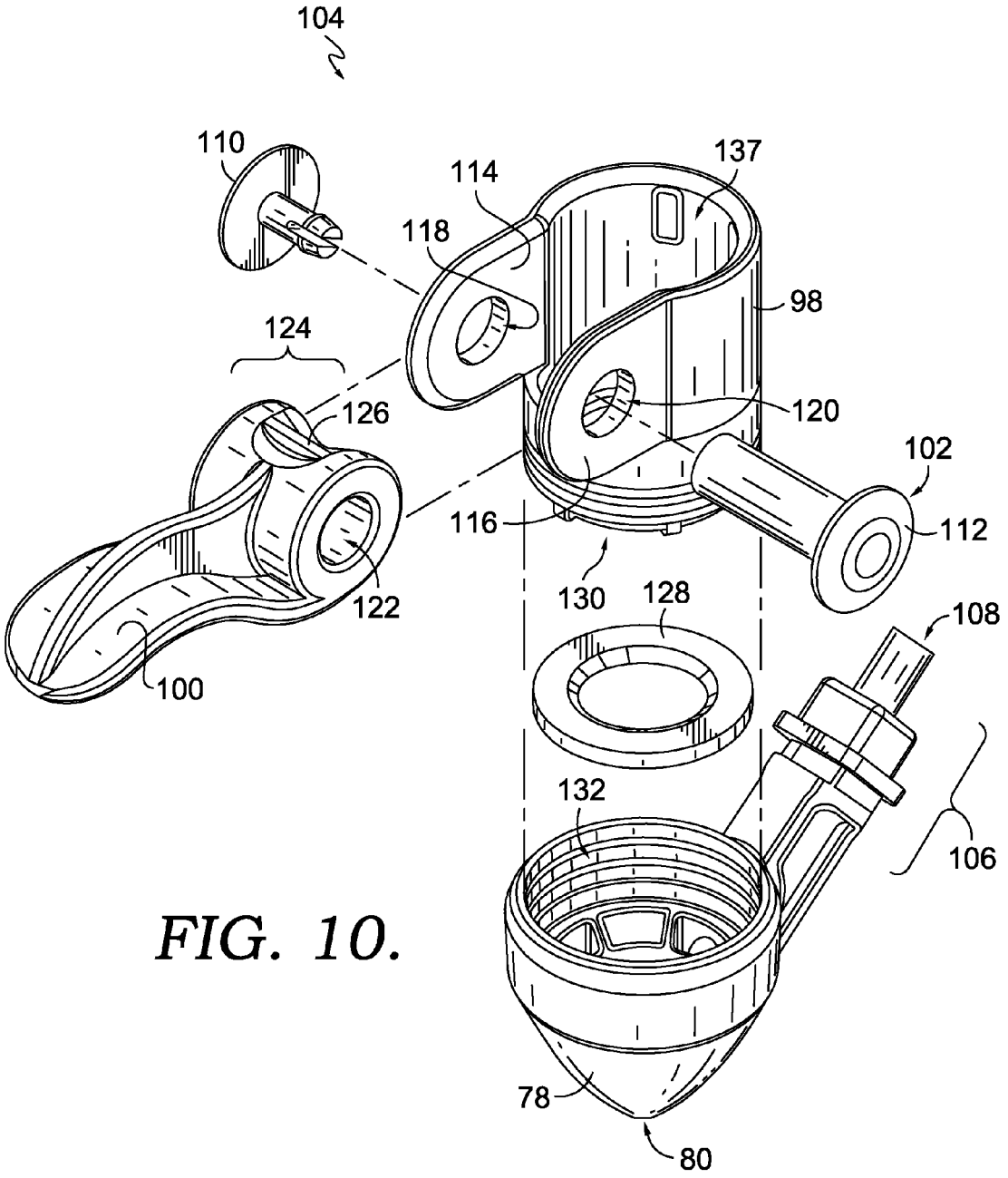
FIG. 10 is an expanded, perspective view of a marker positioner of the marker airbrush device of FIG. 9, in accordance with an embodiment of the invention.

In FIGS. 9-10, a marker airbrush device 94 is depicted in accordance with an embodiment of the invention. The exemplary marker airbrush device 94 of FIG. 9 includes a housing 64 having a first end 66 and a second end 68 arranged along a central y-axis. The airbrush device 94 includes a handle 70 and a trigger 72. Although depicted as a lever to be pulled in relation to the handle 70, the trigger 72 may be any sort of device used to provide an indication of stopping and starting the flow of air through the marker airbrush device 94. For example, the trigger 72 may be a button or a sensor that a user contacts to indicate when air should flow through marker airbrush device 94.

Marker airbrush device 94 further includes a piece of tubing 74 coupled to the second end 68 of the housing 64. The tubing 74 provides an input for an air source, such as the air pump device 46 discussed above with reference to FIGS. 5 and 6. In embodiments, air pumped into the second end 68 of the housing 64 travels through the housing 64 (via air outlet 86 depicted in FIG. 8) and exits the airbrush device 94 via opening 80, after passing through the marker positioner 96. Embodiments of the marker positioner 96 include a conical tip 78 that accepts the marking end of a marking device 82. The marking device 82 may have a marker nib that is saturated with an amount of marking solution, such that the solution saturating the marking device is "airbrushed" onto a surface based on air traveling through the marker airbrush device 94. As shown in FIG. 9, a marking device 82 may be secured by the marker positioner 96, and positioned at an angle 84 relative to the horizontal y-axis of the marker airbrush device 94.

In one embodiment, the marker positioner 96 positions the marking device 82 with respect to one or more parts of the marker airbrush device 94. As shown in the example of FIG. 9, the marker positioner 96 includes a marker collar 98 that secures the marking device 82 based on a position of the locking lever 100. As discussed below with reference to FIGS. 11-13, locking level 100 pivots about a rotation joint 102 into one of multiple positions with respect to the marker airbrush device 94 and/or the marking device 82. In embodiments, the locking lever 100 may be engaged in two different positions to secure different types of marking devices 82. In one embodiment, the locking lever 100 is adjusted into a first position with at least a first portion of the locking lever 100 directly adjoining an exterior surface of the marking device 82. In a further embodiment, the locking lever 100 may be adjusted into a second position with at least a second portion of the locking lever 100 directly adjacent an exterior surface of the marking device 82. For example, the locking lever 100 may be adjusted into a first position when securing a miniature-sized marking device 82, while the locking lever 100 may be further adjusted into a second position when securing a regular-sized marking device 82.

In the expanded, perspective view of FIG. 10, the components 104 of marker positioner 96 include the marker collar 98 that engages with the locking lever 100 and is secured by fastener 110 upon mating with pin 112. In particular, marker collar 98 includes arms 114 and 116 that extend from the marker collar 98 and include corresponding openings 118 and 120. As such, at rotation joint 102, the pin 112 is inserted through opening 120 of arm 116, opening 122 of locking lever 100, and opening 118 of arm 114, and further coupled to fastener 110 to restrict lateral movement of the pin 112 with respect to the marker collar 98. In embodiments, locking lever 100 is rotatably coupled (at rotation joint 102) to the marker collar 98 based on mating of the fastener 110 to the pin 112, which is inserted through arms 116 and 118 and opening 122.

In further embodiments, based on movement of locking lever 100 about rotation joint 102, the positioning mechanism 124 of the locking lever 100 includes a locking segment 126 that engages against at least a portion of a marking device, such as a front end of a marking device 82. As such, a marker positioner 96 may include a locking lever 100 having one or more locking segments 126 that engage against an outer surface of marking device, such as a collar and/or tip of a marking device 82. In embodiments, positioning mechanism 124 is an s-detent on a surface of the locking lever 100, while locking segment 126 is a standing rib that spans at least a portion of the positioning mechanism 124. In further embodiments, positioning mechanism 124 includes multiple locking segments 126 having varying heights within the s-detent of positioning mechanism 124, to provide varying locking positions of the locking lever 100. Accordingly, in further embodiments, one or more locking segments 126 are configured to mate against one or more different sizes of marking devices 82. In one embodiment, each locking segment 126 coupled to a positioning mechanism 124 is configured to mate against a particular-sized marking device 82, such as a first locking segment 126 configured to mate against a miniature-sized marking device 82, and a second locking segment 126 configured to mate against a regular-sized marking device 82.

As further shown in the enlarged view of FIG. 10, the components 104 of marker positioner 96 may include a connection mechanism 106 (having tubing 108) for connecting the marker positioner 96 and conical tip 78 to a remainder of the housing 64 and related components of the marker airbrush device 94, as well as a stabilizing ring 128 that secures the marker collar 98 against the interior cavity 132 of the conical tip 78. In embodiments, stabilizing ring 128 is an O-ring made of a material that mates to surfaces of the neighboring components, such as a thermoplastic elastomer (TPE) and/or rubber stabilizing ring 128. As shown in FIG. 10, the interior cavity 132 of the conical tip 78 includes a ribbed surface that engages against the nib of a marking device, such as the nib 36 of marking device 32 in FIG. 3. In some embodiments, the marker positioner 96 includes a series of ribs and/or protrusions on the interior cavity 132 that hold the nib of a marking device at a particular depth inside of the conical tip 78. In further embodiments, based on the nib of a marker device adjoining one or more of the ribbing structures on the interior cavity 132 of the conical tip 78, the marker positioner 96 maintains a constant distance between the marker nib and the opening 80 (and/or air outlet 86).

In embodiments, the stabilizing ring 128 restricts movement of the tip of a marking device secured by the marker positioner 96. In one embodiment, coupling of the marking device 82 with the stabilizing ring 128 secures the marking device 82 inside the marker positioner 76 such that the air flowing from an air outlet contacts at least a portion of the marker nib on the marking device 82. In some embodiments, air flowing through the marker airbrush device 94 contacts at least a portion of a collar of the marking device 82 and at least a portion of the marker nib. As such, air contacting the marking device 82 may be "targeted" to contact a particular portion of the marking device 82 based on positioning of the marking device 82 by the marker positioner 96 (and the corresponding orientation of the marking device 82 inside the hollow interior 132). In one example, air flowing through marker airbrush device 94 may travel across the nib of the marking device 82, collect an amount of marking solution in the air stream, and release a spray of marking solution out of the opening 80 to create an "airbrush" effect. In other words, the marker airbrush device 94 may transfer marking solution from the marking device 82 (i.e., from the marker nib) out of the first end 66 of the marker airbrush device 94, and onto a writing surface, based on securing the marking device 82 with the marker positioner 96.

As previously discussed, embodiments of the invention may utilize many different kinds of marking devices 82, having marker nibs saturated with multiple different types of marking solutions. For example, the marker airbrush device 94 may be used with a variety of broad line markers, such as Regular, Washable, Pip-Squeaks®, Crystal Effects, Window and Bright Fabric markers, by Crayola® LLC of Easton, Pa. As such, embodiments of the marking solution may be a washable marker solution, a non-washable marker solution, a fabric-writing marker solution, a window-writing marker solution, a special-effects marker solution and/or a permanent marker solution. Additionally, the marker airbrush device 94 may be used to transfer solution from a variety of different types of marking devices 82, including but not limited to markers having a marker nib and/or marker reservoir saturated in marking solution. In embodiments, marking device 82 is removable from marker airbrush device 94, such that multiple different marking devices may be used individually with marker airbrush device 94. In some embodiments, stabilizing ring 128 may be adapted to secure different types of marking devices 82, such as marking devices having different circumferences or different shaped housings and/or nibs. In embodiments, the marker positioner 96 of marker airbrush device 94 may be maneuvered into different locking positions corresponding to the outer surface of a regular-sized marking device or the outer surface of a miniature-sized marking device.

Figure 11:
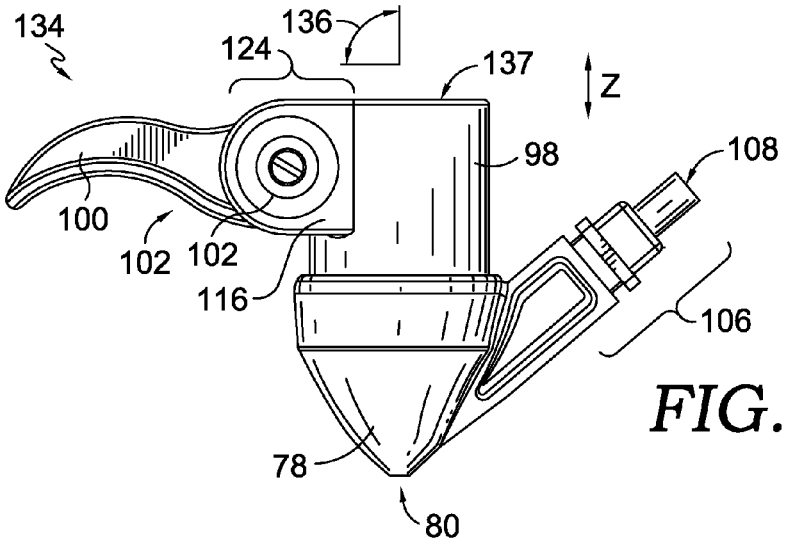
FIG. 11 is a side view of an unlocked marker positioner for securing a marking device in a marker airbrush device, in accordance with an embodiment of the invention.
Figure 12:
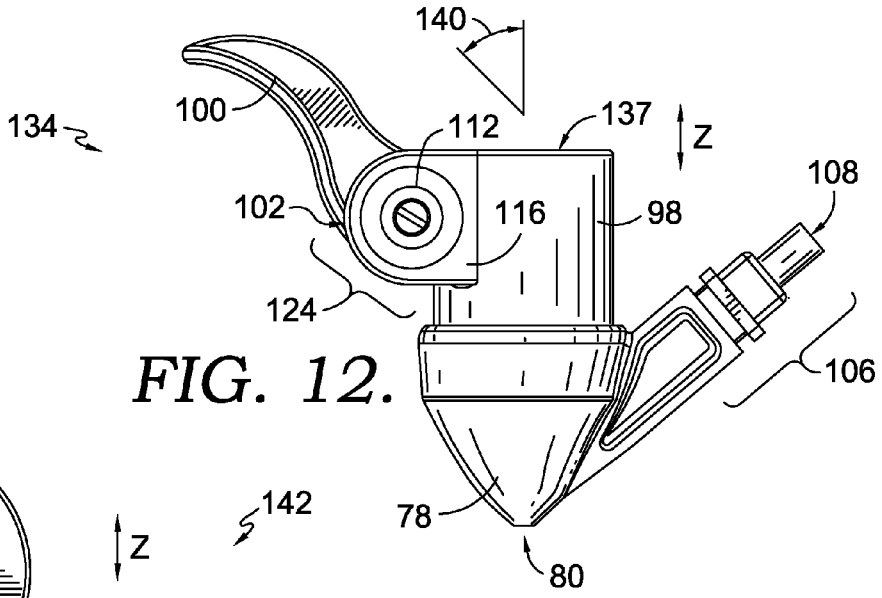
FIG. 12 is a side view of a locked marker positioner for securing a miniature-sized marking device in a marker airbrush device, in accordance with an embodiment of the invention.
Figure 13:
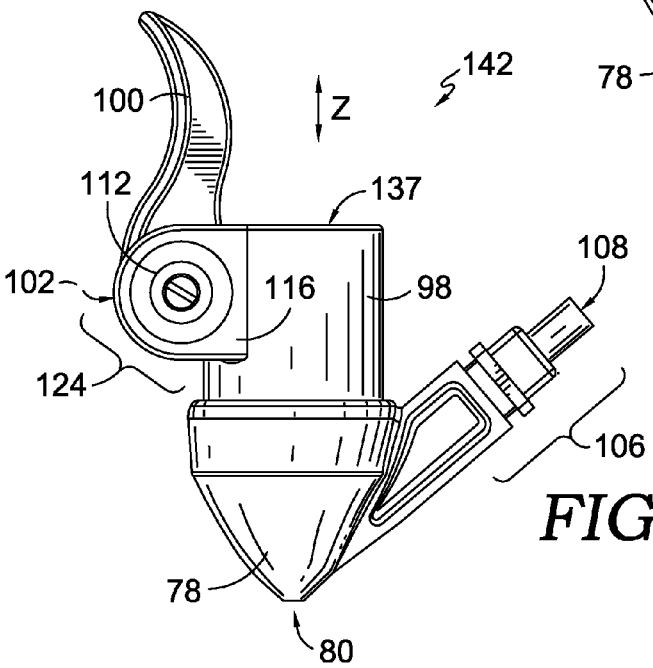
FIG. 13 is a side view of a locked marker positioner for securing a regular-sized marking device, in accordance with an embodiment of the invention.

For example, with reference to FIGS. 11-13, an exemplary marker positioner 134 is manipulated between an unlocked position (FIG. 11), a locked position corresponding to a miniature-sized marking device (FIG. 12), and a locked position corresponding to a regular-sized marking device (FIG. 13). In the unlocked position of FIG. 11, the locking lever 100 is positioned at a 90-degree angle 136 relative to a z-axis of the marker collar 98. As shown in FIG. 12, the locking lever 100 may be pivoted about the rotation joint 102 to orient the positioning mechanism 124 of the locking lever 100 at a particular angle 140 relative to the z-axis. In one embodiment, the particular angle 140 includes an angle between 0 and 90 degrees, such as a 45-degree angle. In embodiments, the position of the locking lever 100 in FIG. 12 secures a miniature-sized marking device 82 inside the marker airbrush device 94. With reference to FIG. 13, the locking lever 100 is pivoted into a position parallel to the z-axis, which orients the positioning mechanism 124 of the locking lever 124 into a position that secures a regular-sized marking device 82 inside the marker airbrush device 94. Accordingly, in embodiments of the invention, the positioning mechanism 124 on the locking lever 100 may be used to secure multiple sizes of marking devices 82 inside the marker airbrush device 94.

Figure 14:
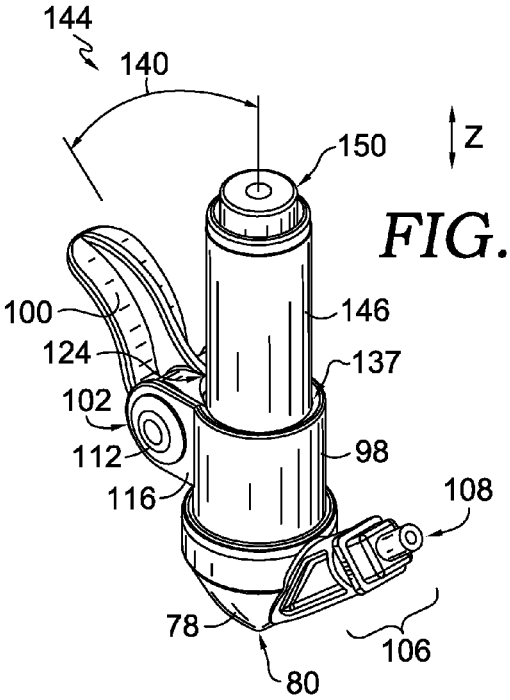
FIG. 14 is a perspective view of a locked marker positioner securing a miniature-sized marking device in a marker airbrush device, in accordance with an embodiment of the invention.
Figure 15:
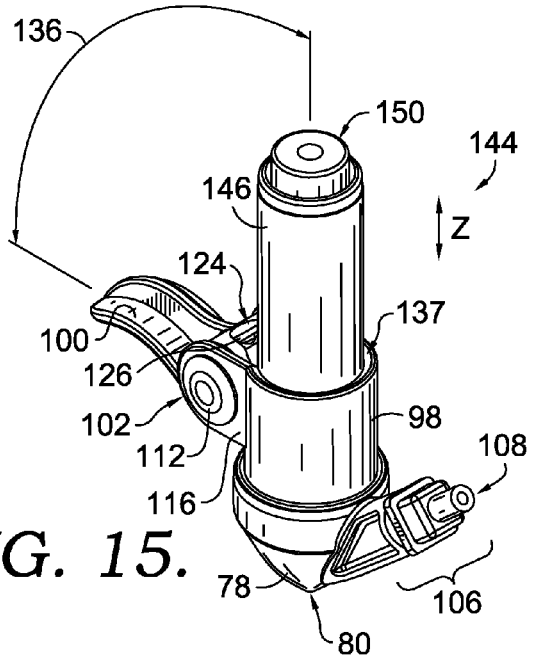
FIG. 15 is a perspective view of the marker airbrush device of FIG. 14, with the marker positioner in an unlocked position, in accordance with an embodiment of the invention.
Figure 16:
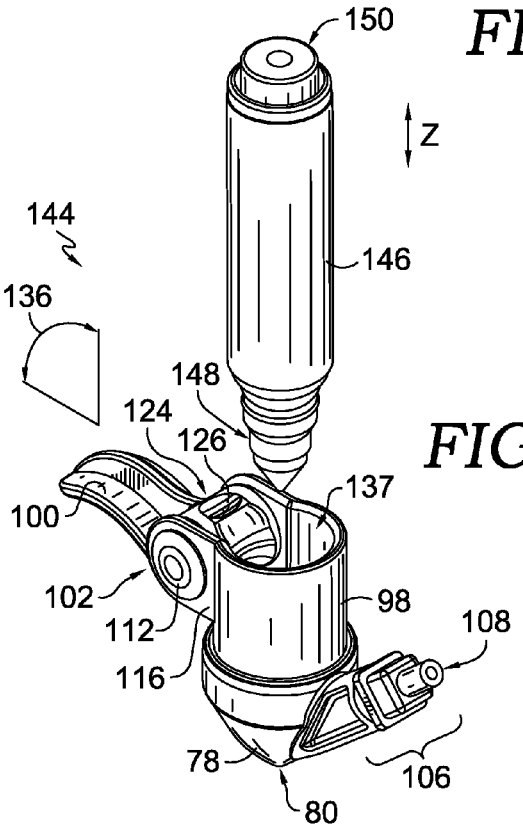
FIG. 16 is a perspective view of the marker airbrush device of FIG. 15, with the miniature-sized marker removed to reveal an interior of the marker positioner, in accordance with an embodiment of the invention.

An exemplary locked, unlocked, and separated view of a marker positioner 144 for use with a miniature-sized marking device 146 is depicted in FIGS. 14-16. In FIG. 14, marking device 146 is locked into a secured position adjacent the positioning mechanism 124, with locking lever at an angle 140. As such, the movement of the marking device 146 is restricted within the internal cavity 137 of marker collar 98, while only the second end 150 of the marking device 146 is exposed. In embodiments, the miniature-sized marking device 146 is restricted from movement within the internal cavity 137 of the marker collar 98 based on the angle 140 of the locking mechanism 100 engaging the locking segment 126 against at least a portion of the marking device 146, such as a marker collar and/or housing. Upon rotation of the locking lever 100 to a position perpendicular to the marking device 146, at angle 136 shown in FIG. 15, the marking device 146 is removable from the marker collar 98 based on the separation of locking segment 126 (and at least a portion of the positioning mechanism 124) from the outer surface of the marking device 146. Further, as shown in FIG. 16, the first end 148 of the marking device 146 may be removed from the marker positioner 144 based on decoupling of the marker positioner 144 and the marking device 146 upon unlocking of the locking lever 100.

Figure 17:
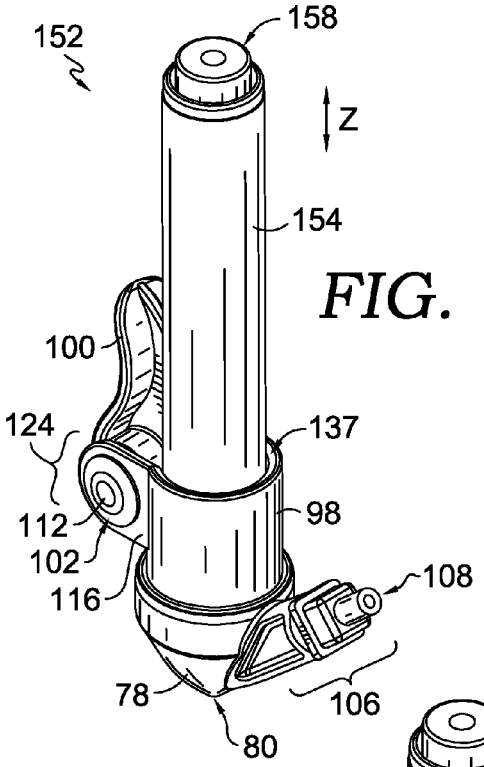
FIG. 17 is a perspective view of a locked marker positioner securing a regular-sized marking device in a marker airbrush device, in accordance with an embodiment of the invention.
Figure 18:
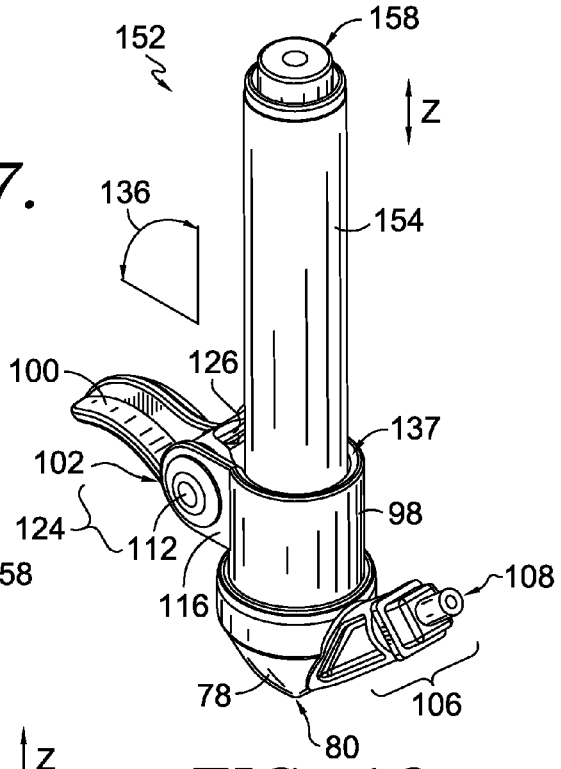
FIG. 18 is a perspective view of the marker airbrush device of FIG. 17, with the marker positioner in an unlocked position, in accordance with an embodiment of the invention.
Figure 19:
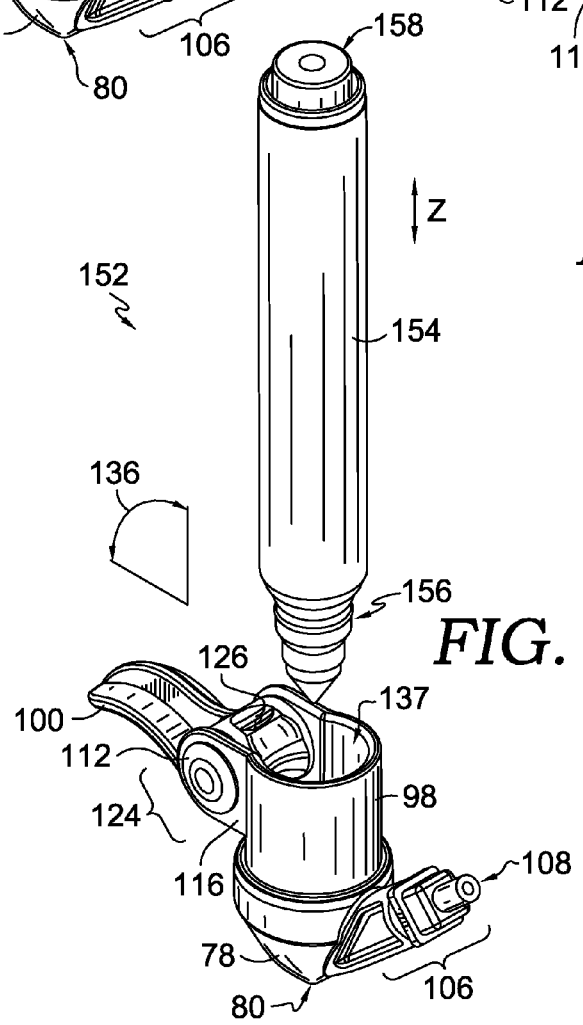
FIG. 19 is a perspective view of the marker airbrush device of FIG. 18, with the regular-sized marking device removed to reveal an interior of the marker positioner, in accordance with an embodiment of the invention.

Turning now to FIGS. 17-19, an exemplary locked, unlocked, and separated view of a marker positioner 152 for use with a regular-sized marking device 154 is depicted according to embodiments of the invention. In FIG. 17, marking device 154 is locked into a secured position adjacent the positioning mechanism 124, with locking lever at a position parallel to the z-axis of the marker collar 98. As such, the movement of the marking device 154 is restricted within the internal cavity 137 of marker collar 98, while only the second end 158 of the marking device 154 is exposed. In embodiments, the regular-sized marking device 154 is restricted from movement within the internal cavity 137 of the marker collar 98 based on the parallel positioning of the locking mechanism 100 engaging the locking segment 126 against at least a portion of the marking device 154, such as a marker collar and/or housing. Upon rotation of the locking lever 100 to a position perpendicular to the marking device 154, as shown in FIG. 18, the marking device 154 is removable from the marker collar 98 based on the separation of locking segment 126 (and at least a portion of the positioning mechanism 124) from the outer surface of the marking device 154. Further, as shown in FIG. 19, the first end 156 of the marking device 154 may be removed from the marker positioner 152 based on decoupling of the marker positioner 152 and the marking device 154 upon unlocking of the locking lever 100.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A marker airbrush device comprising:

a housing comprising an air outlet and a trigger for controlling an amount of air travelling through the air outlet; and a marker positioner coupled to the housing, wherein the marker positioner is configured to position at least a portion of a marking device relative to the air outlet such that air traveling through the air outlet contacts at least the portion of the marking device to transfer marking solution from the marking device onto a writing surface, wherein the marker positioner comprises a conical tip and a rotatable collar rotatably engaged within a first portion of the conical tip such that at least a portion of the rotatable collar is configured to rotate relative to the conical tip and is configured to rotate independently of the housing, wherein the housing is secured to a second portion of the conical tip, wherein the rotatable collar is configured to adjust a position of at least the portion of the marking device at a particular depth relative to the air outlet, wherein at least the portion of the rotatable collar rotates around a circumference of the marker device.

2. The device of claim 1, wherein the housing comprises an opening through which air travelling through the air outlet exits the housing, wherein the air carries the marking solution for disbursement onto the writing surface.

3. The device of claim 2, wherein the marker positioner is configured to position a tip of the marking device in a path of the air travelling through the air outlet.

4. The device of claim 3, wherein being configured to position the tip of the marking device in the path of the air travelling through the air outlet comprises being configured to position at least a portion of a marker nib in the path of the air exiting the housing and at least a portion of a marker.

5. The device of claim 1, wherein the marker positioner is configured to position at least the portion of the marking device at a particular angle relative to the housing.

6. The device of claim 5, wherein being configured to position at least the portion of the marking device at the particular angle relative to the housing comprises being configured to position the marking device such that the air traveling through the air outlet contacts at least a portion of a marker nib at a first angle and at least a portion of a marker housing at a second angle.

7. The device of claim 1, wherein the marker positioner comprises a height adjustment mechanism coupled to the rotatable collar;

wherein rotation of the rotatable collar in a first direction is configured to advance the marking device into a path of air flowing through the air outlet; and wherein rotation of the rotatable collar in a second direction is configured to retract the marking device from the path of air flowing through the air outlet.

8. The device of claim 1, wherein the housing further comprises:

a tubing coupled to the housing; and a hand-pumping device coupled to the tubing, wherein air pumped from the hand-pumping device travels through the air outlet via the tubing, and further wherein an amount of air traveling through the air outlet from the pumping device is controlled by the trigger.

9. The device of claim 1, wherein the rotatable collar is configured to rotate in a first direction relative to the conical tip and the housing is configured to remain stationary when the rotatable collar is rotated in the first direction.

10. The device of claim 1, wherein the housing comprises a first end with the air outlet and a second end, the first end and the second end being along a horizontal axis of the housing, wherein the rotatable collar is configured to rotate relative to the conical tip around an axis that is not parallel to the horizontal axis.

11. A marker airbrush device comprising:

a housing having a first end and a second end, the housing comprising an air outlet, an opening through which air travelling through the air outlet exits the housing, and a trigger for controlling an amount of air travelling through the air outlet;

a marker positioner coupled to the first end of the housing, wherein the marker positioner is configured to position at least a portion of a marking device at a particular depth relative to the air outlet such that air traveling through the air outlet contacts at least one surface of the marking device to transfer marking solution from the marking device onto a writing surface;

wherein the marker positioner comprises a conical tip and a rotatable collar, the rotatable collar being for adjusting a position of at least the portion of the marking device at the particular depth relative to the air outlet, wherein the rotatable collar is rotatably engaged within the conical tip such that at least a portion of the rotatable collar is configured to rotate relative to a first portion of the conical tip and configured to rotate independently of the first end of the housing, wherein the housing is secured to a second portion of the conical tip;

and further wherein the marker positioner comprises a height adjustment mechanism coupled to the rotatable collar, wherein rotation of the rotatable collar in a first direction is configured to advance the marking device into a path of air flowing through the air outlet based on travel of the height adjustment mechanism relative to the housing, and wherein rotation of the rotatable collar in a second direction is configured to retract the marking device from the path of air flowing through the air outlet based on travel of the height adjustment mechanism relative to the housing; and a hand-pumping device coupled to the second end of the housing, the hand-pumping device adapted to pump air through the air outlet.

12. The device of claim 11, wherein the marker positioner is configured to position a tip of the marking device in a path of the air travelling through the air outlet.

13. The device of claim 12, wherein being configured to position the tip of the marking device in the path of the air travelling through the air outlet comprises being configured to position at least a portion of a marker nib in the path of the air exiting the housing.

14. The device of claim 12, wherein being configured to position the tip of the marking device in the path of the air travelling through the air outlet further comprises being configured to position at least a portion of a marker housing in the path of air exiting the housing, wherein the portion of the marker housing comprises at least a portion of a marker housing collar at a first end of the marking device.

15. The device of claim 11, wherein the marker positioner is configured to position at least the portion of the marking device at a particular angle relative to the housing.

16. The device of claim 15, wherein being configured to position at least the portion of the marking device at the particular angle relative to the housing comprises being configured to position the marking device such that the air traveling through the air outlet contacts at least a portion of a marker nib at a first angle and at least a portion of the marker housing at a second angle.

17. The device of claim 11, further comprising tubing coupled to the housing, wherein air from the hand-pumping device travels through the air outlet via the tubing.

18. A marker airbrush device comprising:

a housing having a first end and a second end, the housing comprising:

(1) an air outlet at the first end, wherein the first end and the second end are along a horizontal axis of the housing, (2) a trigger for controlling an amount of air travelling through the air outlet;

(3) a marker positioner coupled to the first end of the housing, wherein the marker positioner is configured to position at least a portion of a marking device at an angle relative to the housing such that air traveling through the air outlet contacts at least one surface of the marking device, wherein the marker positioner comprises a conical tip with a hollow interior and a rotatable collar rotatably engaged within a first portion of the conical tip such that the rotatable collar is configured to rotate relative to the conical tip and independently of the first end of the housing to secure the position of the marking device with respect to the marker positioner, wherein the rotatable collar is configured to rotate relative to the conical tip around an axis that is not parallel to the horizontal axis of the housing, wherein the housing is secured to a second portion of the conical tip; and (4) an opening through which air traveling through the air outlet exits the marker positioner, wherein the hollow interior of the marker positioner is tapered toward the opening.

19. The device of claim 18, further comprising a hand-pumping device coupled to the second end of the housing via a tubing, the hand-pumping device adapted to pump air through the air outlet.

* * * * *